US006173447B1

(12) United States Patent
Arnold

(10) Patent No.: US 6,173,447 B1
(45) Date of Patent: Jan. 16, 2001

(54) DEMOUNTABLE PROTECTIVE EYE SHIELD ASSEMBLY FOR CAP VISOR

(76) Inventor: Gary L. Arnold, 31 Dorchester St., Wilmington, MA (US) 01887

( * ) Notice: Under 35 U.S.C. 154(b), the term of this patent shall be extended for 0 days.

(21) Appl. No.: 08/969,229

(22) Filed: Nov. 13, 1997

(51) Int. Cl.[7] ..... A42B 1/06
(52) U.S. Cl. ..... 2/10; 2/219.13
(58) Field of Search ..... 2/10, 209.13, 206, 2/6.3, 6.5, 6.7, 424, 195.1; 351/155

(56) References Cited

U.S. PATENT DOCUMENTS

| | | | |
|---|---|---|---|
| 5,261,124 | 11/1993 | Day | 2/10 |
| 5,473,778 | 12/1995 | Bell | 2/10 |
| 5,581,807 | 12/1996 | Peterson | 2/10 |

*Primary Examiner*—Danny Worrell
(74) *Attorney, Agent, or Firm*—John D. Gugliotta

(57) ABSTRACT

A demountable protective eye shield assembly is provided which shields and person's eyes and/or eyeglasses from rain water, salt water, and other foreign matter. The eye shield assembly is adapted for removable clamping engagement with the visor of a baseball cap or other item of headgear having a visor and includes a clamp body with upper and lower jaws for clamping onto the outermost edge of a visor. The clamp body includes a gutter means which traps water flowing generally to the front of the visor and redirects such water to either side of the clamp body for draining substantially out of the wearer's field of vision. Finally, the eye shield assembly includes an eye shield which is pivotally attached to the clamp body for pivotal movement between a first, primary operative position in which it shields a person's eyes or eyeglasses from rain. spray or other foreign matter, and a second non-operative position in which it is disposed substantially over the visor of the headgear and out of the user's field of vision. The shield includes an upper edge which is curled over backwards to form a lip that straddles the clamp body's gutter means when the shield is in its first, primary operative position. The shield's lip serves to force water impinging onto it from generally above to drain either forward and down the front face of the shield or backwards and onto the gutter means of the clamp body where it will then be directed to either side of the assembly for draining as described above. Included in the assembly are means for locking the eye shield in at least its second, non-operative position to retain the same out of the user's field of vision when desired by the user.

9 Claims, 8 Drawing Sheets

DEMOUNTABLE PROTECTIVE EYE SHIELD ASSEMBLY FOR CAP VISOR

FIELD OF THE INVENTION

This invention relates generally to protective eye and eyeglass shields, and more particularly to a demountable protective eye shield which is mountable to the visor of baseball cap and other headgear that includes a visor of the general type found on baseball caps.

BACKGROUND OF THE INVENTION

Numerous shield devices have been designed for shielding persons' eyes and/or eyeglasses from foreign matter such as rain, sand, dust, mud, and water from sources other than rain. Some of these devices have been stand-alone devices such as goggles, which are complete for use within themselves and may be attached directly to a user's head for use. Others have been adapted for attachment to headgear which is placed on a user's head. The present invention relates generally to the latter type of shield. Some of these devices have been the subject matter of United States patents. Three patented devices relevant to the instant invention are briefly discussed below.

Preliminarily, as is discussed in the background of the invention section of U.S. Pat. No. 5,581,807, there has been inconsistent use of the term "visor" in the art to which that invention and the present invention pertains. In U.S. Pat. No. 5,581,807, the specification defines an extension of the crown of a hat or cap that extends generally forward, and for example casts shade on the eyes, as a "bill" or a "brim". A "visor", as defined in U.S. Pat. No. 5,581,807, is restricted to a transparent lens or shield to be operatively positioned in front of the eyes of the user. For the sake of clarity, in this patent, the term "visor" refers to the forwardly extending portion of a hat, cap, or other headgear (i.e., that portion referred to as a "bill" or "brim" in U.S. Pat. No. 5,581,807), while the lens or shield referred to as a "visor" in U.S. Pat. No. 5,581,807 is referred to as a "shield," "eye shield," or "eyeglass shield" in this patent.

U.S. Pat. No. 5,261,124 issued to Sheng-Tong Day on Nov. 16, 1993 discloses perhaps the closest configuration to the present invention. It includes a clip body for clipping onto the visor of a cap and an eye shield that is pivotally attached to the clip body so that it can be pivoted into a downward, protective position in which it is in front of the eyes and an upward, nonprotective position. The eye shield's pivoting motion between operative and nonoperative positions is where the similarity with the present invention lies. However, as will be appreciated further in the description, the present invention differs in the way it is attached to the visor of a cap and further provides additional features to prevent water from dripping from the visor into the user's eyes or onto the user's eyeglasses.

U.S. Pat. No. 5,473,778 issued to Bell on Dec. 12, 1995 is only remotely related to the present invention in that is provides for a shield that is carried by a baseball-type cap which slides between a first position in which it is adjacent the crown of the cap and hidden from view therebehind, above the visor of the cap, and a second position in which it is below the cap visor (i.e., "bill") where it shields the eyes of the user. The shield translates vertically in linear fashion through a slot which is disposed between the crown and bill of a specially designed cap; there is no pivotal attachment or movement of the shield with respect to the cap or its bill.

U.S. Pat. No. 5,581,807 issued to Peterson on Dec. 10, 1996 is more closely related to the invention of U.S. Pat. No. 5,473,778 in that its shield portion is adapted to be received within the crown of the headgear to which it is attached. However, as will be appreciated, like the present invention, the eye shield (i.e, what is referred to as the visor in U.S. Pat. No. 5,581,807) has ends and is co-extensive around part of the circumference of the headgear to which it is attached.

One disadvantage shared by all three of the prior inventions discussed above is that none provides a means for preventing water, such as rain water, that lands on the visor portion of the cap or other headgear, from draining off the front portion of the visor where it may distract the wearer as it flows or drips in his or her field of vision or, worse, lands in his or her eyes or on his or her eyeglasses if the shield is being worn to prevent water from impinging on the wearer's glasses. Fresh water contacting ones eyes or eyeglasses directly can be annoying and even dangerous, particularly if one is concentrating on an activity which requires unobstructed vision. Once particularly hazardous, annoying, and sometimes damaging scenario is the impinging of salt-water spray into the eyes, or onto the eyeglasses of a person while piloting a boat in rough seas. Where a person in this situation has no glasses on, salt water spray contacting the eye directly can be uncomfortable and, in many situations, extremely distracting and therefore dangerous. Where a person wears eyeglasses, either regular prescription glasses or regular or prescription sunglasses, and allows salt water spray to come into direct contact with the same, the salt water often dries on the lenses leaving behind a salt residue which obstructs vision or, if the user attempts to wipe the residue away, leaves scratches in the lenses thereby destroying them over time.

While it seems no shield can be kept completely free of water under the circumstances described, the elimination of the water that collects on a cap visor and then drains into a person's field of vision, onto a protective shield, or into their eyes or onto their glasses in extremely useful and a function which is not performed by any known prior devices.

The instant invention alleviates the difficulty discussed above and provides further advantages and objectives which are stated explicitly below or will be implicit to a user.

SUMMARY OF THE INVENTION

It is an object of this invention to provide a protective shield for covering and protecting the eyes and/or eyeglasses of a user, which shield may be clamped onto the visor portion of a cap or other headgear having a visor of the general type found on baseball caps.

It is a further object of this invention to provide a shield which is pivotally attached to a clamp body which body may in turn be clamped to the visor portion of a cap or the like so that the shield portion may be pivotally moved between a downward, operative position in which it is generally in front of the user's eyes or eyeglasses to protect his or her eyes and/or eyeglasses from rain water, salt water spray and the like, and an upward, inoperative position in which the shield portion is substantially out of the user's field of vision.

It is a further objective of this invention to provide a gutter means included on the clamp body, which gutter means is in substantially water tight engagement with the visor portion of the headgear so that water accumulating on the visor and draining forwardly down the visor may be collected and directed off to either side of the gutter, out of the user's field of vision.

The above and other objects are achieved in accordance with the present invention which, according to a first embodiment provides a clamp body which in most cases, as viewed from the top or bottom, is substantially C-shaped and co-extensive with the outermost edge of a visor extending from a cap or other headgear. The clamp body extends from a right end to a left end. The clamp includes an upper jaw and a lower jaw, each of which includes an inner and outer surface, and is best made of a resilient material so that the jaws can be opened slightly and clamped onto the outermost edge of the visor to which the assembly is to be attached. When the clamp body is properly placed on the visor, at least the inner surface of the top jaw is in substantially water tight engagement with the top surface of the visor along the entire length of the jaw. Extending substantially perpendicularly upward from the outer surface of the upper jaw, along substantially its entire length, is a water retaining wall. It is preferable that the rearwardmost portion of the upper jaw of the clamp body (i.e., that portion of the upper jaw closest the crown of the cap on a baseball cap, for example.) be tapered downward at an angle toward the upper surface of the visor. When the assembly is in position on the visor, water landing on the visor will accumulate and run down the visor where it will eventually encounter the upper jaw of the clamp body. Because the upper jaw is in water tight engagement with the upper surface of the visor, the water will ride over the tapered portion of the upper jaw where it will be prevented from draining off the front of the visor by the water retaining wall. Instead, the water retaining wall will direct the water off to either side of the clamp body where it will be free to drain to either side of the wearer's head thereby preventing the draining water from obstructing the user's vision or landing in the user's eyes or on his or her eyeglasses.

Adjacent the right and left ends of the clamp body are right-hand pivot assembly and left-hand pivot assembly, respectively. The mechanical details for one embodiment of these assemblies is discussed in the detailed description, but numerous ways of achieving the same desired function for these pivot assemblies will occur to those of ordinary skill, and the particular manner in which the desired functions of the pivot assemblies are achieved is immaterial to the invention as long as the method chosen achieves the desired function. The pivot assemblies are where the shield is pivotally attached to the clamp body. The shield is preferably translucent and may be transparent or tinted, depending on whether one of its functions is to be the filtering of light or harmful rays to prevent such rays from entering the eye. The shield has a front face, a rear face, a bottom edge and a top edge, and is substantially co-extensive with the clamp body. The shield further has a right side and a left side and it contains a portion of the right-hand pivot assembly in its right side and a portion of the left-hand pivot assembly in its left side.

When the clamp body is in place on a visor, the shield is pivotable between an operative, protective position in which it is located in front of the user's eyes and an inoperative, nonprotective position in which it is flipped up over the visor and substantially out of the user's field of vision. The pivot assemblies are designed such that the shield is "lockable" in at least the two positions just described. The top edge of the shield is preferably curled to form a lip such that when the shield is in its operative position, a portion of it extends rearwardly and over the retaining wall of the clamp body. This preferred design prevents water impinging on the shield assembly from the top or front from running down the rear face of the shield where it may drip onto the user's face, eyeglasses or into his or her eyes. Instead, water impinging on the shield's lip will drain either to the front face of the shield or rearwardly, over the retaining wall and onto the outer surface of the upper jaw of the clamp body where it will ultimately be guided by the retaining wall off to either side of the clamp body for draining.

Other objects, features, and advantages of this invention will occur to those skilled in the art from the following description of a preferred embodiment of the present invention and the accompanying drawings.

DETAILED DESCRIPTION OF THE PREFERRED EMBODIMENT

Figure 1:
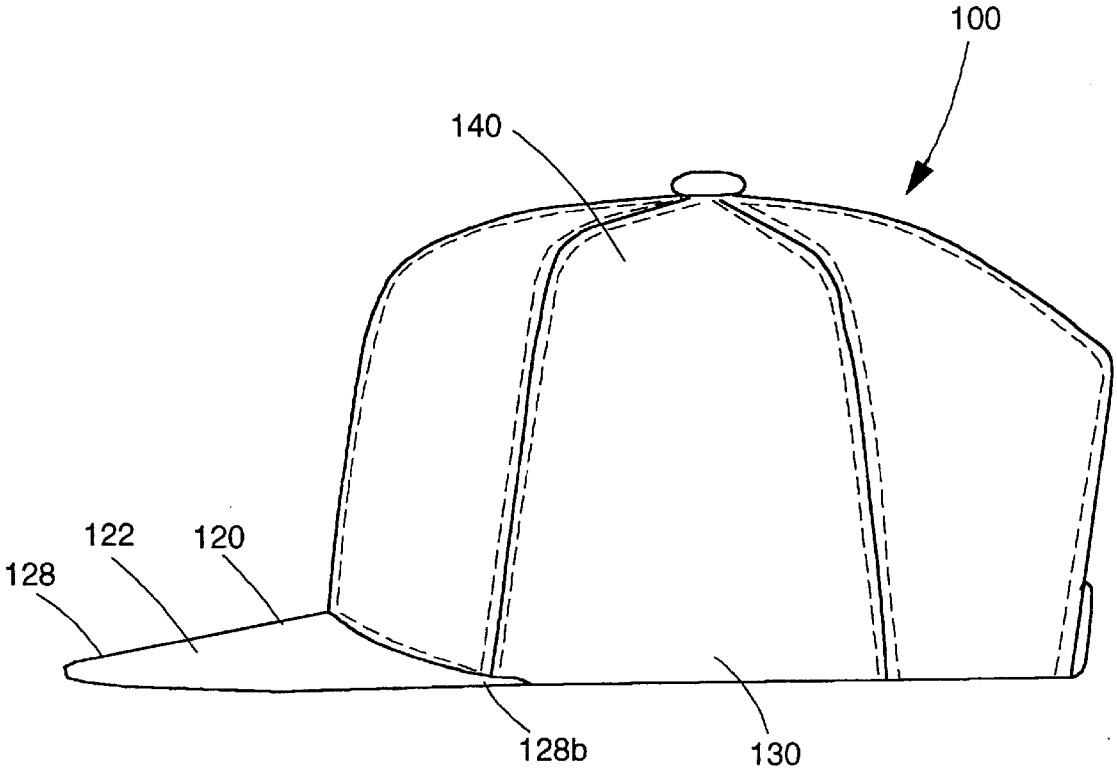
FIG. 1 is a left side view of a baseball cap; a typical item of headgear to which the present invention may be attached.

There is shown in FIGS. 1 through 12 a demountable protective eye shield assembly for a cap visor 10 (hereinafter "eye shield assembly") according to a preferred embodiment of the present invention. Eye shield assembly 10 comprises a clamp body 20, an eye shield 50, and a right-hand pivot assembly 60 and a left-hand pivot assembly 80, the pivot assemblies 60 and 80 providing a means for pivotally attaching eye shield 50 to clamp body 20 and residing partially in clamp body 20 and eye shield 50.

Figure 2:
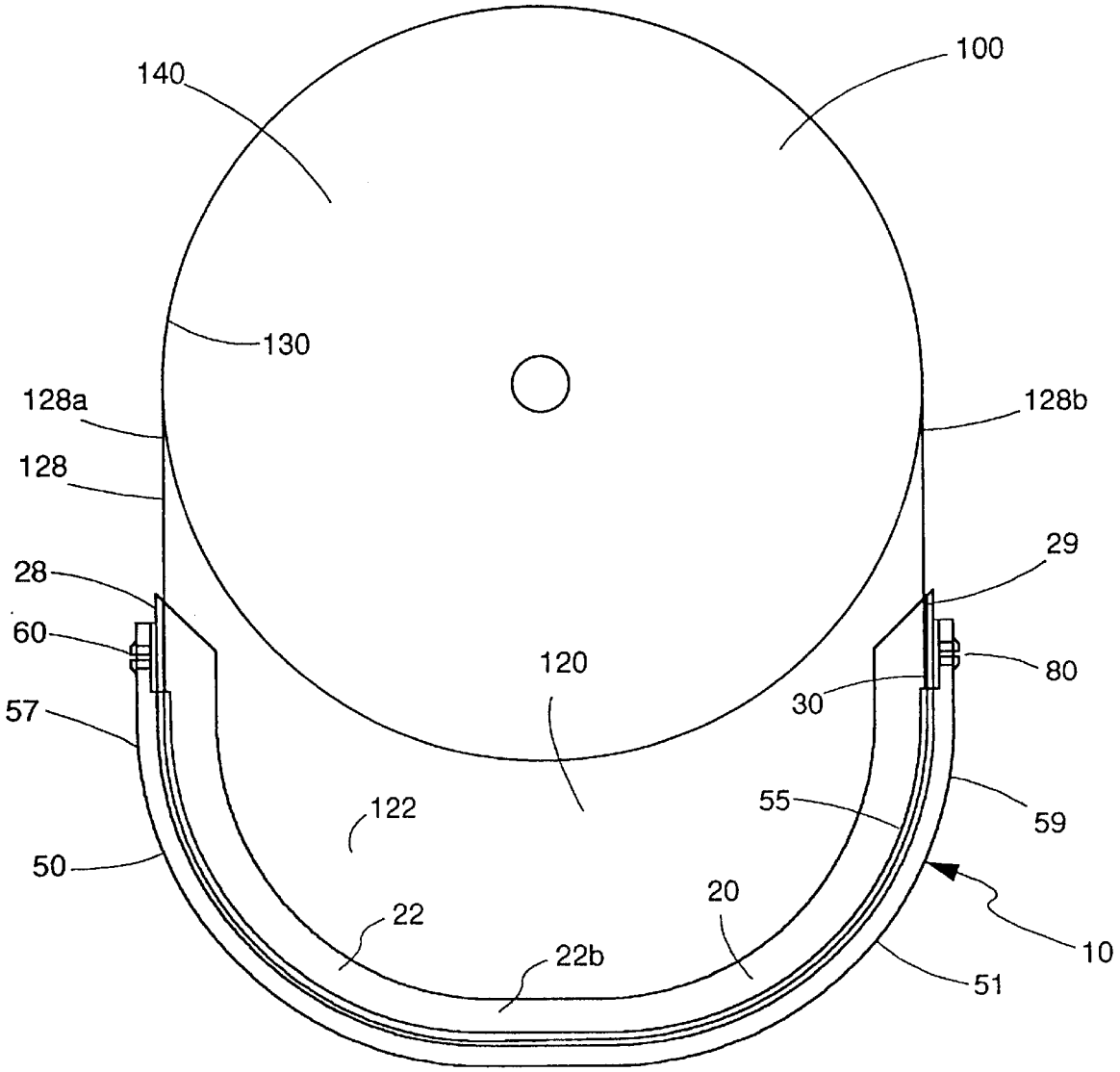
FIG. 2 depicts a top view of the preferred embodiment of the present invention clamped to a baseball cap.
Figure 3:
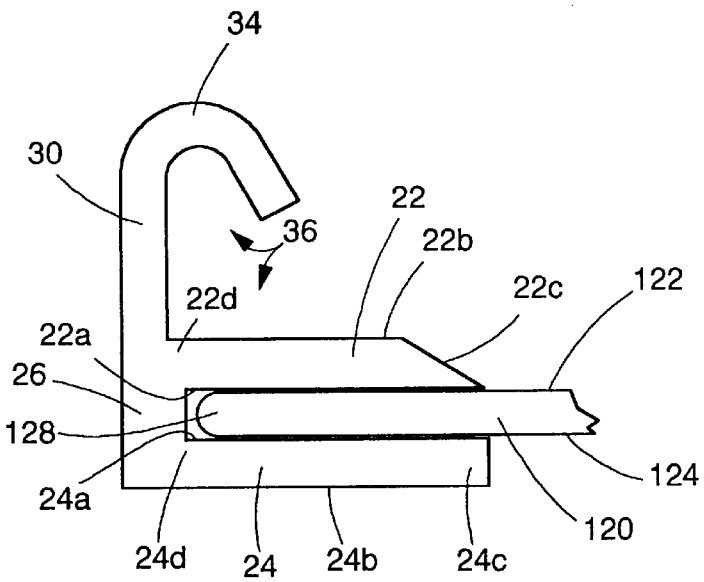
FIG. 3 is a left side cross-sectional view of the clamp body of the preferred embodiment.

As seen most clearly in FIG. 2, clamp body 20 includes an upper jaw 22 and a lower jaw 24. Upper jaw 22 has inner surface 22*a* and outer surface 22*b* and a rear end 22*c* and a forward end 22*d*, while lower jaw 24 has inner surface 24*a* and outer surface 24*b* and back end 24*c* and a front end 24*d*. Upper jaw 22 and lower jaw 24 are joined by jaw joining wall 26 or other suitable joining means and cooperate to form a clamp-like structure which is illustrated in the cross-sectional side views of FIGS. 2 and 3. Attached to and extending substantially vertically upwardly from forward end 22*d* or joining wall 26, or both, is water retaining wall 30 which is preferably, though not necessarily, integrally molded with outer surface 22*b* of upper jaw 22 to form a water tight junction between the two. Water retaining wall 30 may, after extending upwardly for some distance, be curled rearwardly toward rear end 22*c* of upper jaw 22 to create a gutter lip 34. Providing gutter lip 34 augments the water retaining capability of retaining wall 26 as will be more fully appreciate further in this description. Where gutter lip 34 is provided, outer surface 22*b* of upper jaw 22, water retaining wall 30, and gutter lip 34 collectively provide gutter means 36. Where gutter lip 34 is excluded, gutter means 36 comprises outer surface 22*b* and retaining wall 30. Retaining wall 30 need not be located adjacent forward end 22*d* of upper jaw 22, and could in fact be located anywhere along upper jaw 22, but for reasons which will become apparent further in this description, the location detailed above for retaining wall 30 is the best among the alternatives.

Clamp body 20 clamps to the visor 120 of a baseball cap 100, or some other item of headgear with inner surface 22*a* of upper jaw 22 frictionally engaging the top surface 122 of visor 120 and inner surface 24*a* of lower jaw 24 frictionally engaging the bottom surface 124 of visor 120. When in place, clamp body 20 is preferably substantially co-extensive with the outermost edge 128 of visor 120, extending between a right end 28 and a left end 29 as illustrated best in the top view of FIG. 1. Outermost edge 128 of visor 120 extends from a right side end point 128*a* to a left side end point 128*b*, end points 128*a* and 128*b* defining the points of attachment of outermost edge 128 with the headband 130 of baseball cap 100 or other item of headgear. For purposes of this specification, all items of headgear which include visors have headbands 130, the headband being defined generally as that portion of an item of headgear that circumscribes at least a portion of a person's head to hold the item of headgear in place on a person's head. In the case of baseball cap 100, the headband is located in the lowermost portion of the crown 140 and is most commonly an inch to an inch and one half in height. When clamp body 20 is in place on visor 120, rear ends 22*c* and 24*c* of upper and lower jaws 22 and 24 are the ends, as between forward ends 22*d* and 24*d* and rear ends 22*c* and 24*c*, that are closest to the headband 130 of baseball cap 100 or any other item of headgear.

Figure 10:
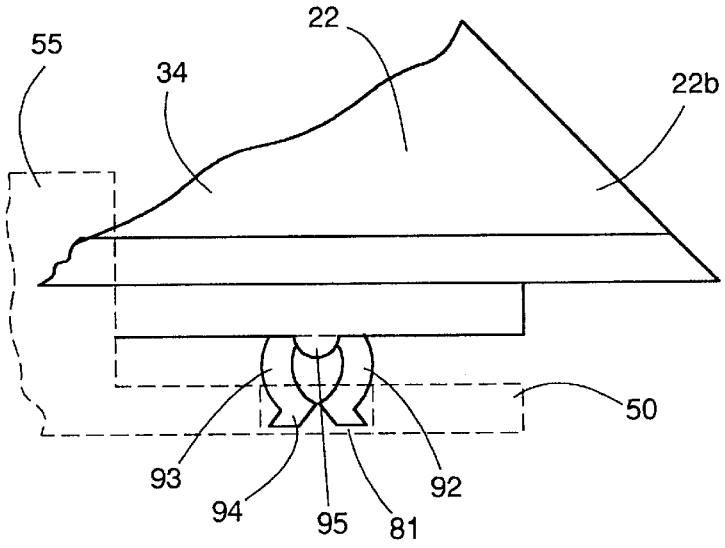
FIG. 10 is a top, sectional view of the left end of the clamp body and the left side of the shield portion of the preferred embodiment being pivotally attached.
Figure 11:
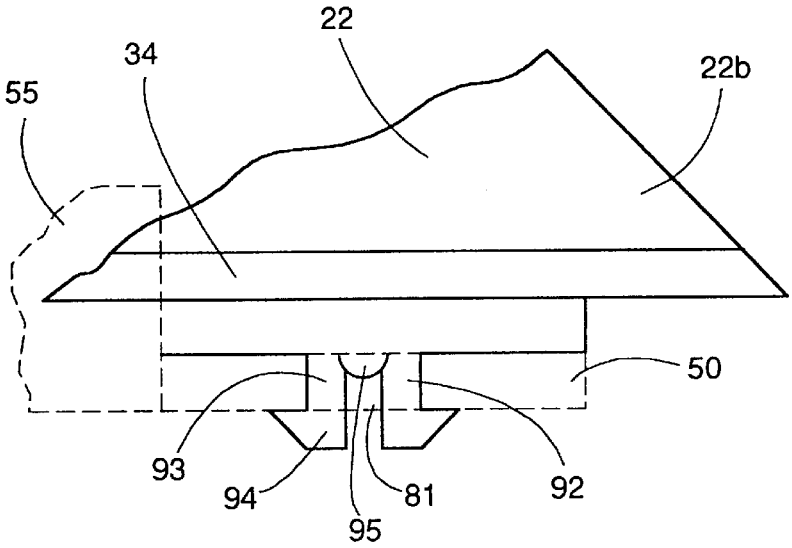
FIG. 11 is a top, sectional view of the left end of the clamp body and the left side of the shield portion of the preferred embodiment after they have been pivotally attached.
Figure 12:
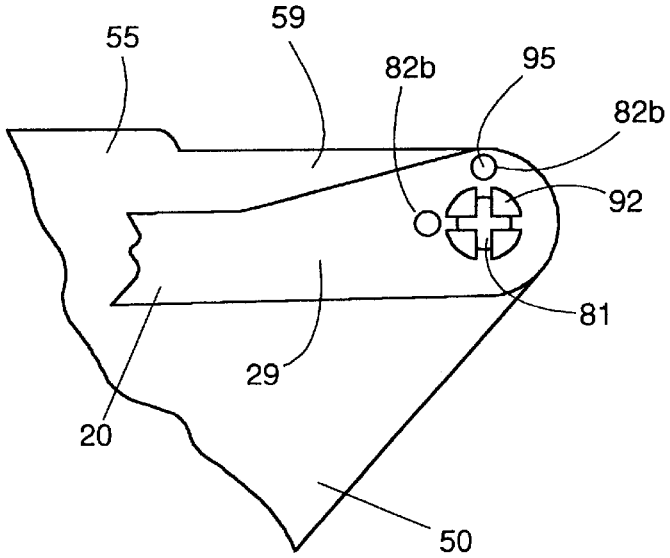
FIG. 12 is a left side, sectional view of the left end of the clamp body and the left side of the shield portion of the preferred embodiment after they have been pivotally attached.

Pivotally attached to clamp body 20 by means to be discussed further in this description is eye shield 50. Eye shield 50 includes a front face 51 and a rear face 52 which are bounded by a bottom edge 53 and a top edge 54 and extend substantially horizontally from a right side 57 to a left side 59. Eye shield 50 is preferably translucent and may be transparent or tinted to varying degrees depending on whether one of its functions is to filter light. Furthermore, top edge 54 of shield 50 is preferably curled over backwards along substantially its entire length to form shield lip 55 for reasons which will be appreciated further in this description. Shield lip 55 may, as illustrated in FIGS. 1, 10, 11 and others, stop short of extending along the entire length of top edge 54 of shield 50 to accommodate the means by which clamp body 20 and shield 50 are pivotally attached. By stating that shield lip 55 extends along "substantially" the entire length of top edge 54, all that is meant is that lip 55 is long enough to direct water to either side of clamp body 20 for draining as desired and described.

Figure 4:
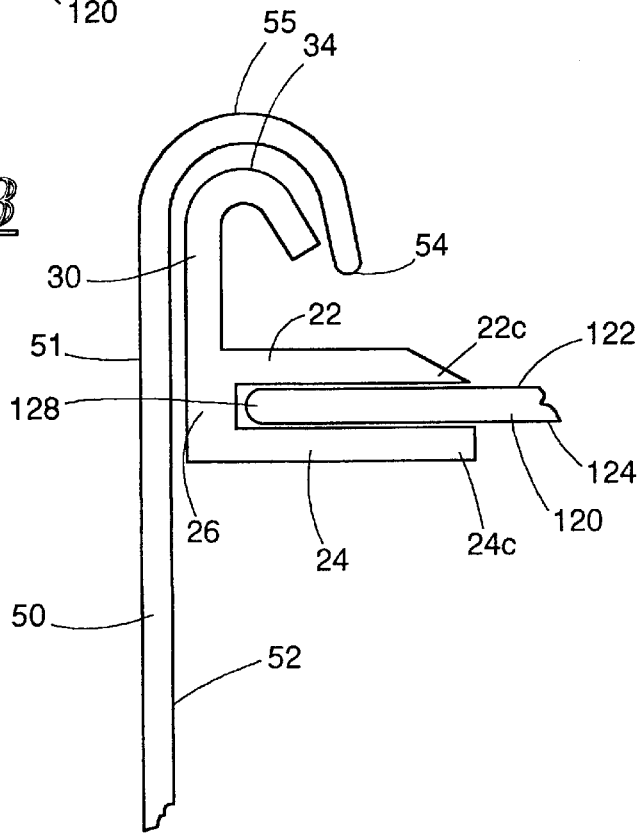
FIG. 4 is a left side cross-sectional view of the clamp body and the eye shield disposed over the gutter means of the clamp body.
Figure 5:
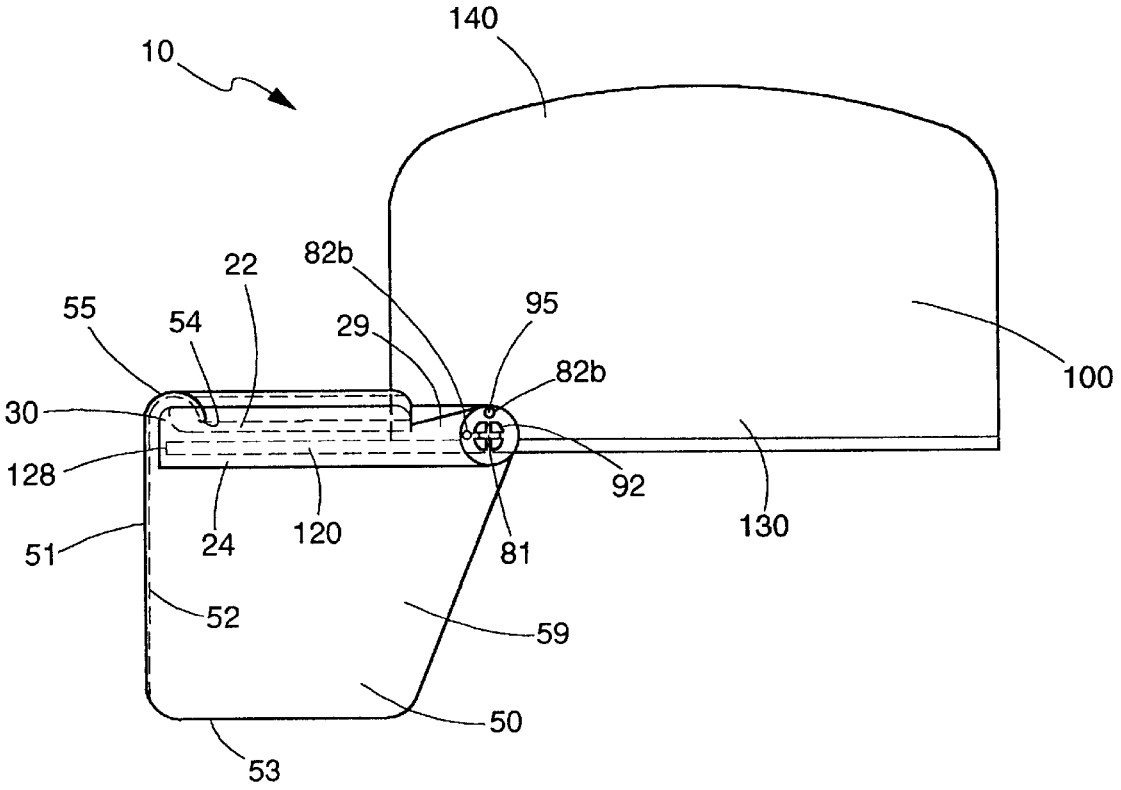
FIG. 5 is a left side view of the preferred embodiment attached to a baseball cap with the eye shield in its first, primary operative position.

As illustrated in FIGS. 4 and 5, the manner in which eye shield 50 is pivotally attached to clamp body 20 ensures that it is pivotable between a first, primary operative position in which it shields a person's eyes or eyeglasses from rain or other foreign matter (FIG. 4), and a second non-operative position in which it is disposed substantially over the visor 120 of cap 100 and out of the user's field of vision (FIG. 5). When shield 50 is in its first, primary operative position, shield lip 55 straddles water retaining wall 30 of clamp body 20 as shown most clearly in the cross-sectional view of FIG. 3. In this way, water impinging on shield lip 55 is forced to drain either forwardly down front face 51 or rearwardly and onto gutter means 34 of clamp body 20.

Turning now to the preferred eye shield attaching means for pivotally attaching eye shield 50 to clamp body 20, there are provided, as previously stated, a right-hand pivot assembly 60 and a left-hand pivot assembly 80. In terms of their components, while they may be mirror images of one another, pivot assemblies 60 and 80 are identical in nature and, therefore, the details of only one are discussed for the purposes of this description with reference to FIGS. 6 through 11.

Figure 6:
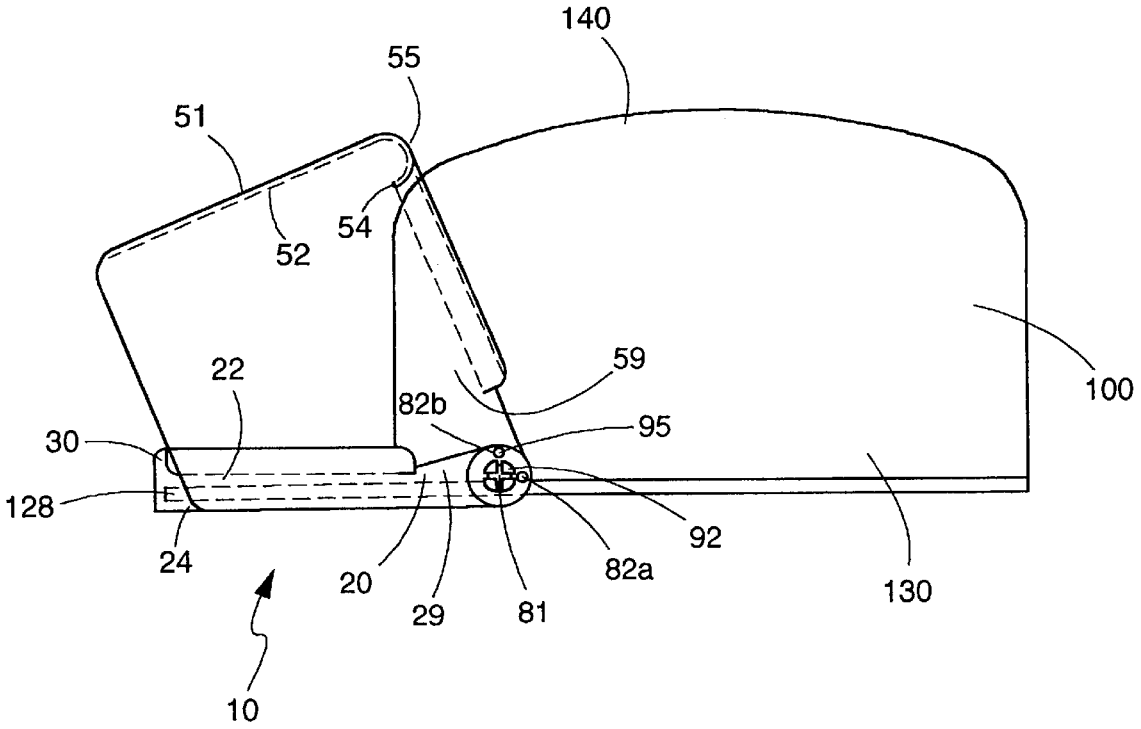
FIG. 6 is a left side view of the preferred embodiment attached to a baseball cap with the eye shield in its second, non-operative position.
Figure 7:
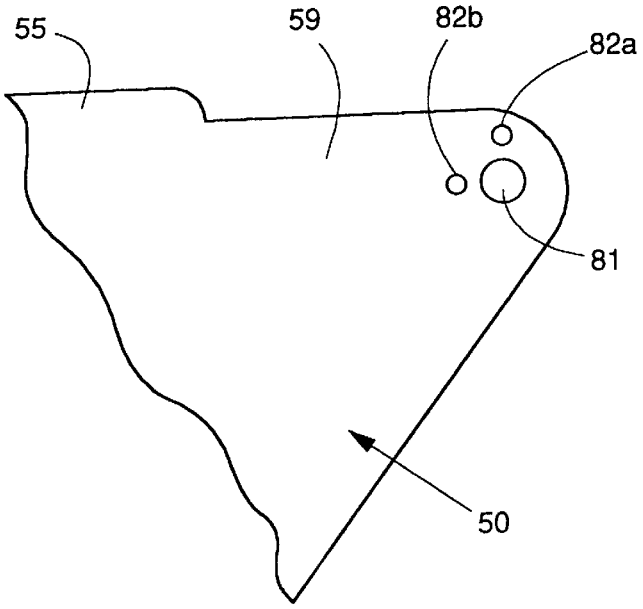
FIG. 7 is a left side sectional view of the left side of the eye shield portion of the preferred embodiment.
Figure 8:
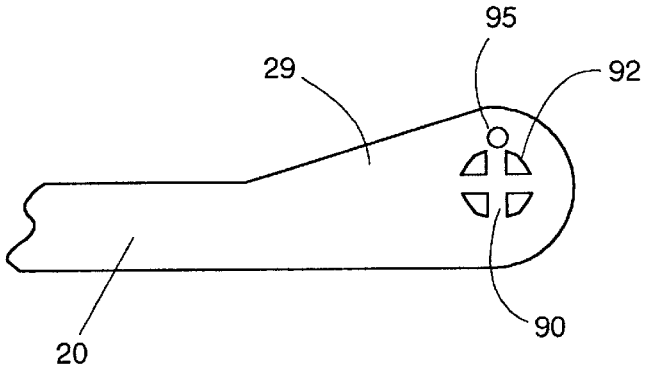
FIG. 8 is a left side view of a the left end of the clamp body portion of the preferred embodiment.
Figure 9:
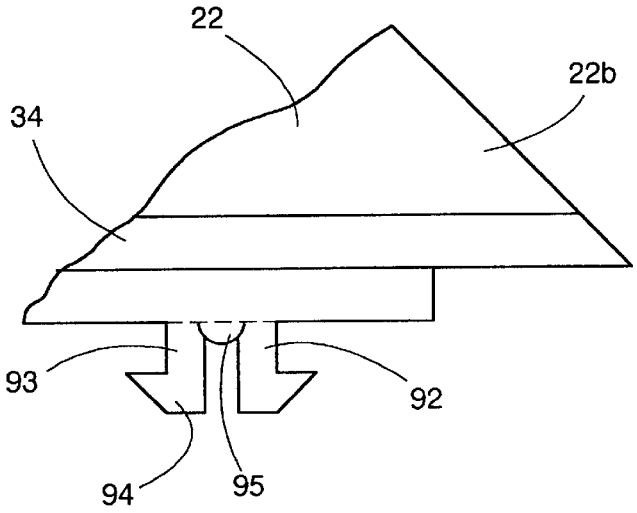
FIG. 9 is a top, sectional view of the left end of the clamp body portion of the preferred embodiment.

As shown in FIG. 6, eye shield 50 is provided in its left side 59 with left-hand pivot aperture 81 and left-hand pivot detents 82*a* and 82*b*. Included in left end 29 of clamp body 20 is left pivot anchor 90, shown in FIG. 7. Left pivot anchor 90 includes flanged protrusions 92 which are resilient for flexing from and returning to a relaxed position. Flanged protrusions 92 are arranged so that their outermost edges lie substantially in a circle. As shown in the top, sectional view of FIG. 8, each flanged protrusion 92 includes a stem 93, which is integral with or otherwise anchored to clamp body 20, and a tapered head 94. Tapered heads 94 are tapered toward clamp body 20 as they extend outwardly to their outermost edges (also the outermost edges of protrusions 92). When flanged protrusions 92 are in their relaxed (ie., unflexed) positions, the outer edges of tapered heads 94 substantially define a circle that is larger in radius than the radius of left-hand pivot aperture 81 in left side 59 of shield 50. As illustrated in the top, sectional view of FIG. 9, with shield 50 shown in phantom lines, stems 93 are capable of flexing inwardly to a point in which the outermost edges of tapered heads 94 substantially define a circle having a radius that is equivalent to or less than the radius of left-hand pivot aperture 81. These properties permit a person to fasten shield 50 to clamp body 20 by aligning tapered heads 94 with pivot aperture 81 such that tapered heads 94 may be urged through aperture 81. As tapered heads 94 are urged through aperture 81, stems 93 flex inwardly to permit the outermost edges of tapered heads 94 to pass through aperture 81. As tapered heads 94 emerge through front face 51 of shield 50, stems 93 are free to return substantially to their relaxed positions, or at least to a position in which the outermost edges of tapered heads 94 are in a configuration having a radius larger than the radius of aperture 81; in this way, clamp body 20 and shield 50 are "snapped" together and pivotable with respect to one another. FIG. 10 is a top, sectional view showing tapered heads 94 after they have emerged through pivot aperture 81, while FIG. 11 is a left side, sectional view of the same components illustrated and discussed in FIG. 10.

As stated previously, it is desirable that eye shield locking means be provided that permit the "locking" of shield 50 with respect to body 20 in at least two positions: a first, primary operative position and a second, non-operative position. At minimum, eye shield locking means should be provided for locking shield 50 in at least its second, non-operative position since, if apparatus 10 is constructed accordingly, gravity can be relied upon to retain shield 50 in its first, primary operative position, at least in the absence of erratic motion by the wearer or turbulence which may be experienced in rough seas, for example. In the preferred embodiment, the means for achieving the desired locking functions are included in the right-hand and left-hand pivot assemblies 60 and 80. As with the mechanisms employed for attaching shield 50 to body 20, the locking mechanisms are discussed with reference to figures depicting left-hand pivot assembly 80.

Adjacent left pivot anchor 90 is at least one pivot detent catch 95 (FIGS. 7–11). Detent catch 95 is preferably integrally molded with, and protrudes from, clamp body 20 and is located and of a size such that when shield 50 is pivoted about pivot anchor 90, detent catch 95 alternately rides along inner face 52 of shield 50 in a circular path between, and possibly outside, the area between detents 82*a* and 82*b* and protrudes into or through detents 82*a* and 82*b* when it is aligned with either of the same. Locking mechanisms of this nature are well known in the art and numerous variations of the same are common. Detent catch 95 is best in the form of a hemisphere so that dislodging catch 95 from detents 82*a* and 82*b* is not rendered unnecessarily difficult. Obviously, for the combination of detent catch 95 and detents 82*a* and 82*b* to function properly, there must be some resiliency in either clamp body 20, shield 50 or both so that detent catch 95 is normally urged in a direction that would have it protrude into one of detents 82*a* and 82*b*, but which is flexible enough to permit the retraction of detent catch 95 from detents 82*a* and 82*b* so that shield 50 may be pivoted into different positions just by the user's pivotally urging shield 50 with respect to clamp body 20 with his or her hand.

There are of course numerous possible configurations that would provide means for pivotally attaching shield 50 to clamp body 20 and the ability to "lock" shield 50 in position with respect to clamp body 20 as described. Included among the alternatives, is the possibility that numerous detents of the same general nature as detents 82*a* and 82*b* be provided to allow for the "locking" of shield 50 in various positions with respect to clamp body 20. Also, detents 82*a* and 82*b* may be in the shape of hemispheres to accommodate preferably hemispherical detent catch 95, or they may be holes bored right through shield 50. Furthermore, even within the confines of the specific pivotal and locking components described above, it makes very little difference which of shield 50 and clamp body 20 contains which components of the specific means for pivotally attaching shield 50 to clamp body 20. All of the numerous various discussed, in addition to those which will occur to those of ordinary skill, are deemed to be within the contemplation of this invention as it is the functionality of the means which is of importance and not the specific manner in which those functions are carried out.

The foregoing is considered to be illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims:

What is claimed is:

1. A demountable protective eye shield assembly for engagement to the visor of an independent item of headgear having a headband and a visor, with the visor of said headgear having an upper surface and a lengthwise outermost edge extending from a right side end point of attachment with the headband of the headgear to a left side end point of attachment with the headband of the headgear, said demountable protective eye shield assembly comprising:

a clamp body having upper and lower jaws with outer surfaces and inner surfaces for removable clamping engagement to at least said upper jaw, said clamp body being of a shape which is adapted to conform with the outermost edge of a visor lengthwise along said upper jaw and extending from a right end to a left end, said inner surface of said upper jaw being adapted for substantially water tight engagement with the upper surface of a visor adjacent its outermost edge when said jaws are in clamping engagement with the visor;

gutter means attached to said upper jaw, said gutter means being substantially coextensive with said upper jaw such that water impinging on the visor, which water would, in the absence of said gutter means, drain off the visor generally into a wearer's field of vision, is trapped by said gutter means and redirected to either side of said clamp body for draining off the visor substantially out of the wearer's field of vision;

an eye shield having a top edge, a bottom edge, a right side, a left side, and front and rear faces bounded by said sides and edges; and eye shield attaching means pivotally attaching said eye shield to said clamp body such that eye shield is pivotable between a first, primary operative position in which it shields a wearer's eyes and a second, non-operative position in which it is disposed substantially above the visor of the headgear.

2. The invention of claim 1 wherein said gutter means comprises a retaining wall attached to and extending substantially vertically upward from said outer surface of said upper jaw and which is substantially co-extensive with said outer surface of said upper jaw.

3. The invention of claim 2 wherein said upper jaw further includes forward and rearward ends, said rearward end being opposite said forward end and being the end of said upper jaw closest the headband of the headgear when said clamp body is clamped to the visor, and wherein said retaining wall is attached to said outer surface of said upper jaw adjacent said forward end so that water impinging on the top surface of the visor drains forward toward the outermost edge of the visor, rides up onto the outer surface of said upper jaw until it encounters said retaining wall by which it will then be trapped and redirected to either side of said clamp body where it will drain off substantially out of a wearer's field of vision.

4. The invention of claim 3 wherein said retaining wall, after extending upwardly for some distance, is curled rearwardly and downwardly toward said rearward end of said upper jaw to form a gutter lip to augment the water trapping capability of said retaining wall.

5. The invention of claim 3 wherein said top edge of said eye shield is curled over backwards to form a shield lip such that when said eye shield is in its first, primary operative position, said shield lip straddles said retaining wall of said clamp body so that water impinging on said shield lip from above said shield lip drains either forwardly toward said front face of said shield or rearwardly and onto said gutter means.

6. The invention of claim 4 wherein said top edge of said eye shield is curled over backwards to form a shield lip such that when said eye shield is in its first, primary operative position, said shield lip straddles said gutter lip of said retaining wall so that water impinging on said shield lip from above said shield lip drains either forwardly toward said front face of said shield or rearwardly and onto said gutter means.

7. The invention of claim 1 further including eye shield locking means which permit the locking of said eye shield in at least its second, non-operative position.

8. The invention of claim 1 wherein said eye shield attaching means comprise a right-hand pivot assembly and a left-hand pivot assembly, said left-hand pivot assembly comprising a left pivot aperture in one of said left side of said eye shield and a left end of said clamp body and a left pivot anchor in the other of said left side of said eye shield and said left end of said clamp body, said right-hand pivot assembly comprising a right pivot aperture in one of said right side of said eye shield and a right end of said clamp body and a right pivot anchor in the other of said right side of said eye shield and said right end of said clamp body, each said pivot anchor comprising a plurality of resilient flanged protrusions, each said protrusion having a stem terminating in a tapered head, said protrusions arranged such that when said protrusions are aligned with either said left pivot aperature or said right pivot aperture, said tapered heads my be urged into either said left pivot aperature or said right pivot aperture, causing said stems to flex inwardly toward one another so that said tapered heads may pass through either said left pivot aperature or said right pivot aperture, and return to a substantially unflexed position in which said tapered heads are in a substantially circular configuration having a radius which is larger that the radius of either said left pivot aperature or said right pivot aperture, thereby pivotally attaching said shield and said clamp body.

9. The invention of claim 8 further comprising eye shield locking means comprising at least one detent adjacent each said pivot anchor in one of said left side of said eye shield and said left end of said clamp body and in one of said right side of said eye shield and said right end of said clamp body; and at least one detent catch adjacent each said pivot anchor in the other of said left side of said eye shield and said left end of said clamp body and in the other of said right side of said eye shield and said right end of said clamp body, said detents being pivotal into alignment with said detent catches such that, when said detents are aligned with said detent catches, said catches protrude into said detents with sufficient resiliency to lock said eye shield in place with respect to said clamp body under a force exerted by the wight of said eye shield, but which locking can be overcome for pivotal movement of said shield's by a user's hand.

* * * * *